US005195121A

United States Patent [19]

Charrier

[11] Patent Number: 5,195,121

[45] Date of Patent: Mar. 16, 1993

[54] X-RAY BEAM MODULATOR

[75] Inventor: Pierre Charrier, St-Hubert, Canada

[73] Assignee: B.C. Medical Ltd., St-Hubert, Canada

[21] Appl. No.: 823,466

[22] Filed: Jan. 22, 1992

[51] Int. Cl.[5] ..... G21K 5/10

[52] U.S. Cl. ..... 378/160; 378/145; 378/159

[58] Field of Search ..... 378/160, 145, 146, 147, 378/149, 150, 153, 156, 157, 158, 159, 99, 62; 358/111

[56] References Cited

U.S. PATENT DOCUMENTS

| | | | |
|---|---|---|---|
| 4,773,087 | 9/1988 | Plewes | 378/160 |
| 4,896,037 | 1/1990 | Shimura et al. | 378/157 |
| 4,916,723 | 4/1990 | Geluk | 378/160 |
| 4,996,700 | 2/1991 | Yamashita et al. | 378/160 |

*Primary Examiner*—David P. Porta
*Attorney, Agent, or Firm*—Robic

[57] ABSTRACT

An apparatus for modulating the intensity of an X-ray beam generated by an X-ray tube. The apparatus comprises a set of at least three blades made of a material opaque to X-ray. Each blade comprises a central hub and a pair of symmetrical wings extending away from the hub. All the blades have their hubs slidably mounted on radially projecting shafts symmetrically positioned about a rotor positioned adjacent the X-ray beam and driven at variable speeds. Matching pins and threads are provided on each pair of hub and shaft to cause the corresponding blade to pivot about the shaft on which it is mounted when the speed of the rotor increases and the blades are then moved in unison radially outwardly against the action of a return spring, because of the centrifugal force. The rotor, the blades and the shafts are positioned and sized to cause the blades to intersect the X-ray beam when the rotor is driven. This in turn causes the blades to modulate the intensity of the X-ray beam as a function of the angular position of the blades about their shafts, which allow more or less radiation to pass therebetween.

10 Claims, 3 Drawing Sheets

X-RAY BEAM MODULATOR

BACKGROUND OF THE INVENTION a) Field of the Invention

The present invention broadly relates to an apparatus for modulating the intensity of an X-ray beam generated in a given direction by an X-ray tube.

More specifically, the invention relates to an apparatus of the above mentioned type, hereinafter called "X-ray beam modulator", that is motorized, remotely controlled and easy to operate, thereby making it easy to use into the X-ray cone and tube assembly of a radiographic system, such as, for example, a system for lower limb angiography, in order to obtain better density and contrast and less radiation exposure of the patient's legs and feet.

b) Brief Description of the Prior Art

It is well known that the X-ray absorption of a body depends on the thickness and/or density of this body. Thus, in a human being, the X-ray absorption varies substantially according to both the portion of the anatomy to be radiographed, and the specific body feature of the patient who is radiographed, depending on the thickness of his or her bones and his or her weight.

Accordingly, there is a need for an apparatus for modulating the intensity of the X-ray beam projected towards a patient, depending on the portion of his or her anatomy to be radiographed and his or her physical condition, in order to achieve proper density and contrast over the entire radiographic film without unduly overexposing some portion of the patient's body.

So far, such a need has been fulfilled with filters of different absorption rates that must be selected and positioned to intersect the X-ray beam according to the radiographic need. Such filters are of course very efficient, but time consuming to install.

SUMMARY OF THE INVENTION

The object of the present invention is to provide an X-ray beam modulator which is simple in structure and very easy to use and remotely control and which can be very easily incorporated into an X-ray cone and tube assembly of conventional structure and used with all kinds of screens and films, in order to vary the intensity of irradiation on some parts of the patients' body such as his or her legs and feet in the case of lower limb angiography, and to generate different compensation curves according to the patient's anatomy.

In accordance with the invention, this object is achieved with an apparatus comprising:

a rotor having a rotation axis parallel to the direction of the X-ray beam, the rotor being positioned adjacent this X-ray beam;

means to drive the rotor about its rotation axis at variable speeds;

a set of at least three blades made of a material opaque to X-ray, each of the blades comprising a central hub and a pair of symmetrical wings extending away from the hub, the blades of the set having their hubs slidably mounted on a corresponding set of radially projecting shafts symmetrically fixed to and about the rotor;

return spring means to urge each of the blades radially inwardly towards the rotor along their respective shafts; and guiding means on each pair of hub and shaft to cause the corresponding blade to pivot about the shaft on which it is mounted when the speed of the rotor increases and the blades are then moved in unison radially outwardly against the action of the return spring means as a result of the centrifugal force.

The blades and their shafts are sized to cause the blades to intersect the X-ray beam when the rotor is driven, and then modulate the intensity of the X-ray beam as a function of the angular position of the blades about their shafts, which allow more or less radiation to pass therebetween.

Advantageously, the apparatus may further comprises programmable control means operatively connected to the means to drive the rotor in order to allow preselection of at least one given speed of rotation of the rotor corresponding to a required compensation curve.

The invention and its advantages will be better understood upon rading the following, non-restrictive description of a preferred embodiment thereof, given with reference to the accompanying drawings.

DESCRIPTION OF A PREFERRED EMBODIMENT OF THE INVENTION

Figure 1:
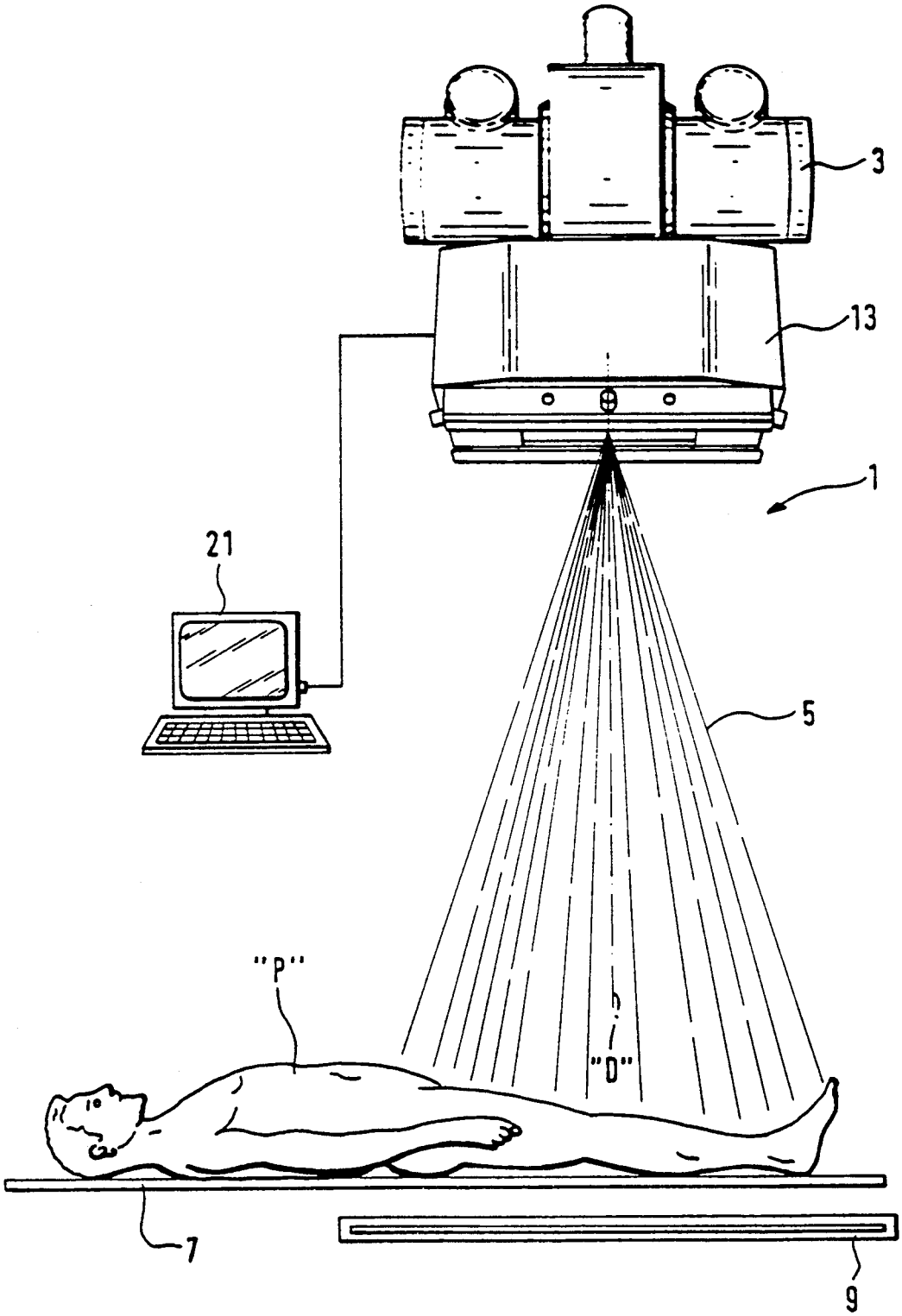
FIG. 1 is a schematic representation of a system for lower limb angiography, showing an X-ray cone and tube assembly incorporating an X-ray beam modulator according to the invention, and a radiographic table on which a patient lays.

FIG. 1 shows a system 1 for lower limb angiography, comprising an X-ray cone and tube assembly 3 of conventional structure, designed to generate an X-ray beam 5 in a given direction "D" towards a radiographic table 7 incorporating a radiographic film cassette 9 mounted in a changer. This kind of equipment wherein the X-ray cone and tube assembly 3 is always centered on the cassette changer is well known in the art and commonly used to take a sequence of radiographic pictures of the lower part of a patient "P". Accordingly, it does not need to be further described.

Figure 2:
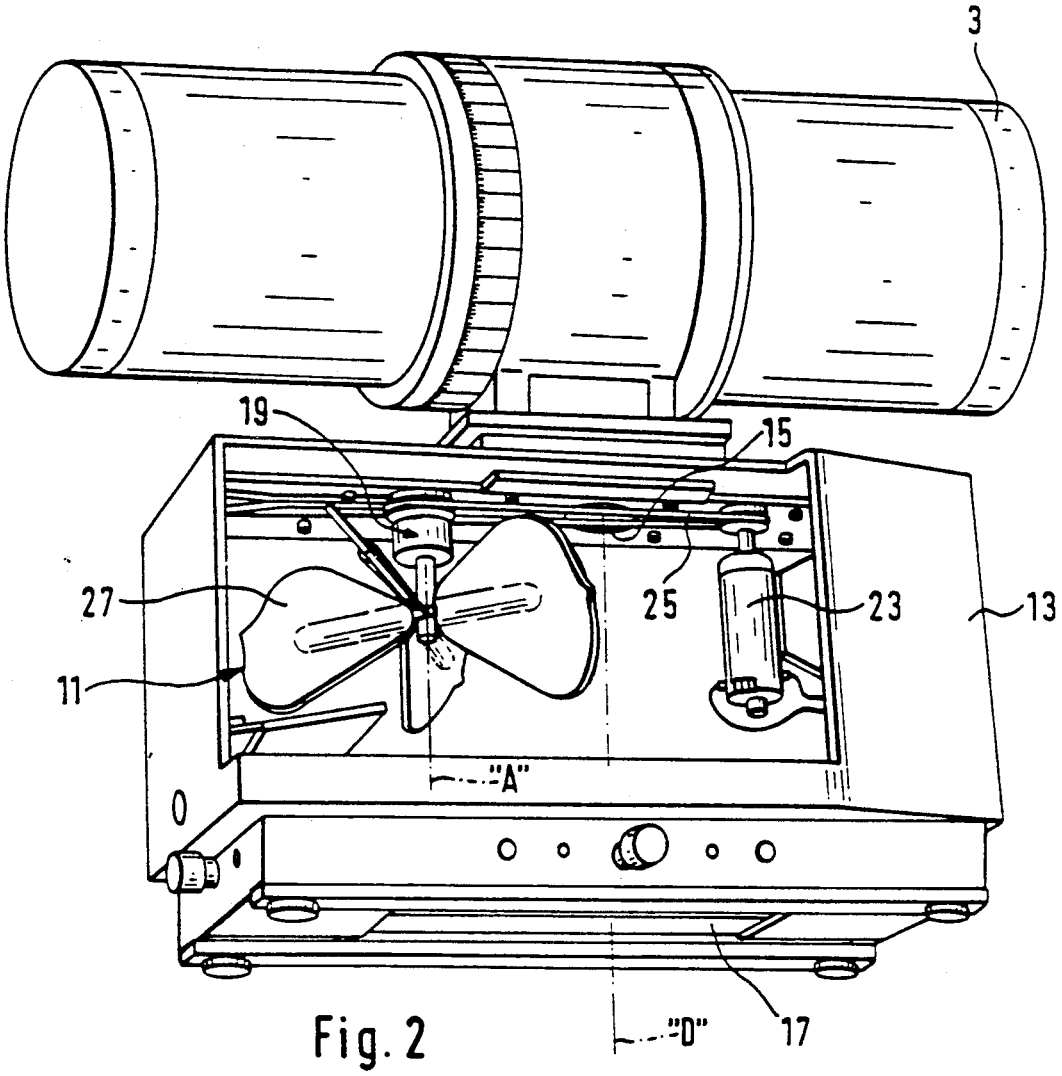
FIG. 2 is a partial semi-open perspective view of the X-ray cone and tube assembly shown in FIG. 1, to show the X-ray beam modulator.

As better shown in FIG. 2, the X-ray cone and tube assembly 3 incorporates an X-ray beam modulator 11 mounted in a large box 13 fixed to the bottom of the assembly 3. The box 13 has a small upper window opening 15 coaxially positioned with respect to the outlet of the X-ray tube, and a large lower window opening 17 that is also aligned with the outlet of the X-ray tube in order to let the X-ray beam 5 pass therethrough.

In accordance with the invention, the X-ray beam modulator 11 located in the box 13 comprises a rotor 19 having a rotation axis "A" parallel to the direction "D". The rotor 19 is positioned close to the upper window opening 15 and thus extends adjacent the X-ray beam 5.

Means are provided for driving rotor 19 about its rotation axis "A" at variable speeds. These means include an electric motor 23 whose shaft is connected via a belt 25 to the rotor 19 in order to drive the same. These means also include remote control means 21 including a rheostat or any other similar device known per se to control the rotation speed of the motor 23 and thus the rotation speed of rotor 19. These control means 27 are preferably associated to a programmable computer to allow preselection of one or more given speeds of rotation of the rotor, corresponding to some required compensation curves, as will be explained hereinafter.

The X-ray beam modulator also comprises a set of at least three and preferably four blades 27 made of a material opaque to X-ray. The blades 27 are identical and each comprises a central hub 29 and a pair of symmetrical wings 31 extending away from the hub 29.

The wings 31 are advantageously shaped to cause variation in the modulation obtained therewith according to their skew angle, and thus to generate different compensation curves as a function of the rotation speed of the rotor, as will be explained hereinafter.

The blades 27 have their hubs 29 slidably mounted on a corresponding member of radially projecting shafts 33 symmetrically positioned about the rotor 19, each shaft being fixed to the rotor by screwing of one of its ends 35 into a receiving hole 37.

Guiding means are provided on each pair of hub and shaft to cause the corresponding blade 27 to pivot about the shaft 33 on which it is mounted, when the speed of the rotor 19 increases and all the blades 27 are then moved in unison radially outwardly along the shafts 33 because of the centrifugal force.

The guiding means preferably comprises a set of rollers 39 freely mounted on pins 41 symmetrically fixed to and projecting from any one of the hub and shaft in such a manner as to engage a corresponding set of threads 43 made in the other one of these hub and shaft. In the illustrated embodiment, the pins 41 projects inwardly from the hub 29 touward the shaft 33 and the threads 43 are made in a cylindrical member 45 coaxially fixed to the shaft 33 away from the rotor 19, this member having an external diameter wider than the shaft 33 so as to define a bearing flange 47.

The hub 29 has an internal diameter substantially identical to the external diameter of the member 45 and an opening 49 adjacent the roto 19. This opening 49 is closed by a guiding ring 51 fixed to the hub by a key 53. Of course, the ring 51 is slidably mounted onto the shaft 33 to allow the blade to slide along this shaft.

Return spring means are provided for urging each of the blades 27 radially inwardly towards the rotor 19 along their respective shafts 33. These return spring means preferably consist of compression springs 55 mounted about the shafts 33 within the hub 29, each spring 55 having one end bearing against the flange 47 and another end bearing against the ring 51.

The pins 41 and their rollers 39 and the threads 43 are positioned in such a manner that the blades 27 extend at a small angle with respect to the direction "D" when the rotor 19 is stopped or driven at low speed, as is shown in FIG. 1, and extends substantially horizontally when the rotor is driven at high speed.

In accordance with the invention, the blades and their shafts 33 are sized to cause the blades to intersect the X-ray beam 5 when the rotor is driven. Assuming that the exposure time is 1/10 sec., the rotation speed of the rotor 19 will be selected to be equal to at least 600 rpm, to prevent the blades from being "radiographed" and thus appear onto the film.

As soon as the motor is driven, the blades 27 are moved radially outwardly by the centrifugal force, and start rotating about their own axis as a result of the combined action of the pins 41 and rollers 39 within the threads 43. The more they slide radially outwardly, the more they rotate and the more they extend horizontally across the beam 5, thereby reducing the amount of irradiation.

Thus, it becomes very simple to modulate the intensity of the X-ray beam 5 as a function of the angular position of the blades 27 about their shafts 33, which itself depends on the speed of the rotor 19 and allow more or less radiation to pass between the blades.

As aforesaid, shape of the winfs 31 of the blades 27 may be selected to achieve variation in the modulation obtained therewith according to the skew angle of the blades 27, and thus to generate different compensaton curves as a function of the rotation speed of the rotor.

Moreover, the programmable control means may be used to preselect one or more given speeds of rotation of the rotor corresponding to some required compensation curves adapted to the patient's anatomy and fatness.

Figure 3:
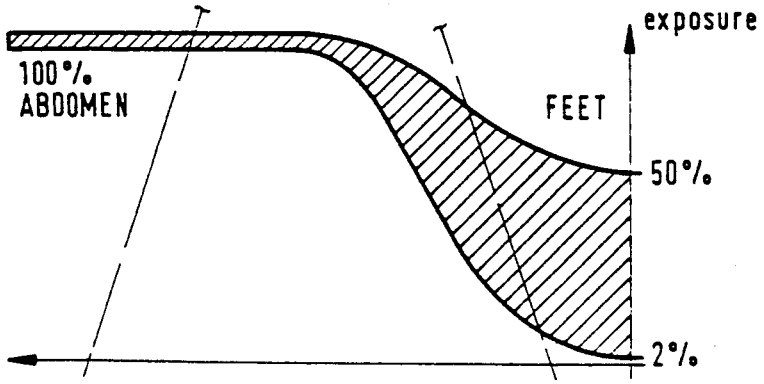
FIG. 3 is a diagramm showing the variation in the percentages of exposition to X-ray that can be achieved with the X-ray modulator according to the invention, from the abdoment to the feet of a patient.
Figure 4:
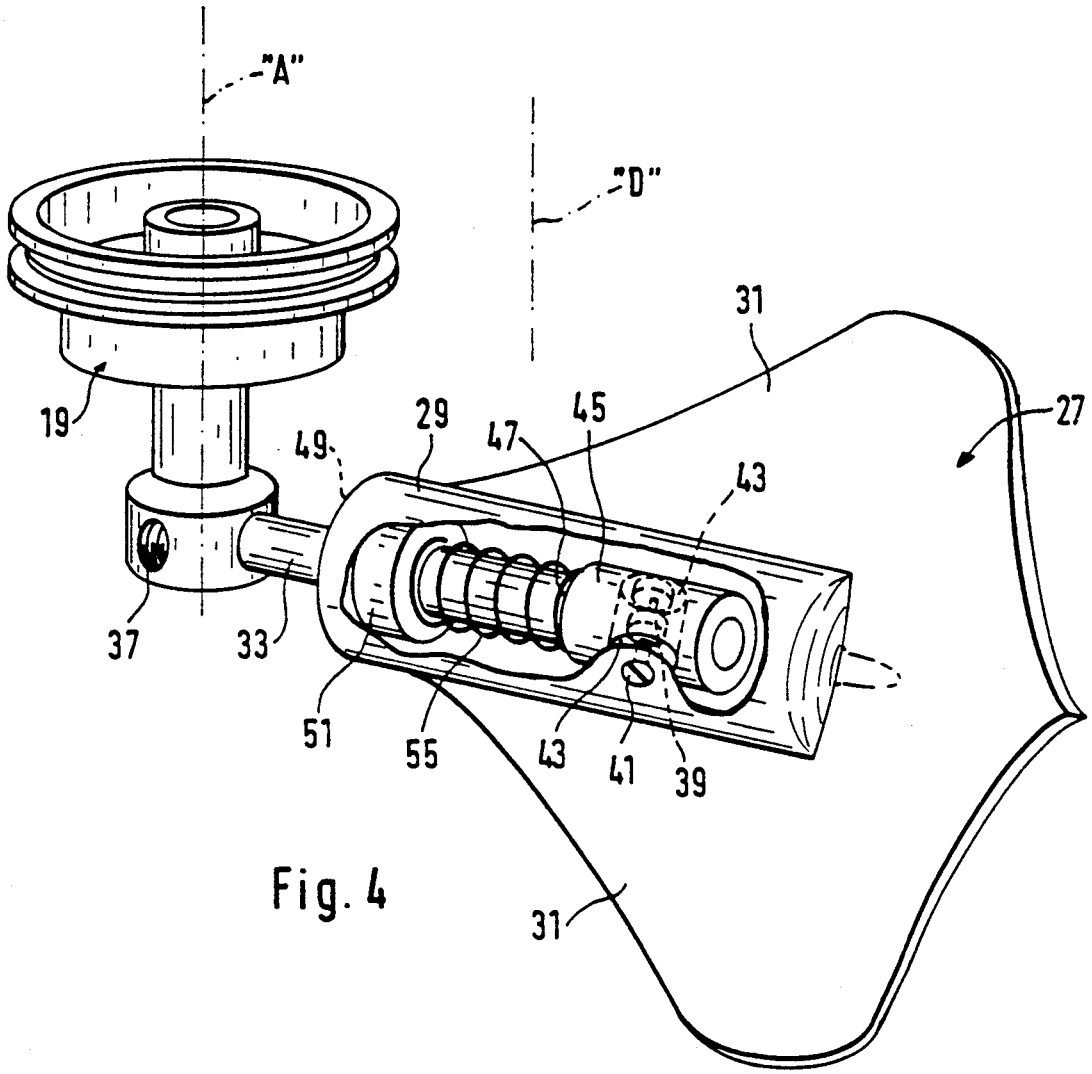
FIG. 4 is a semi-broken perspective view of the rotor and of one of the blades of the X-ray modulator visible in FIG. 2, showing the way the blade is slidably and pivotably mounted onto its shaft.
Figure 5:
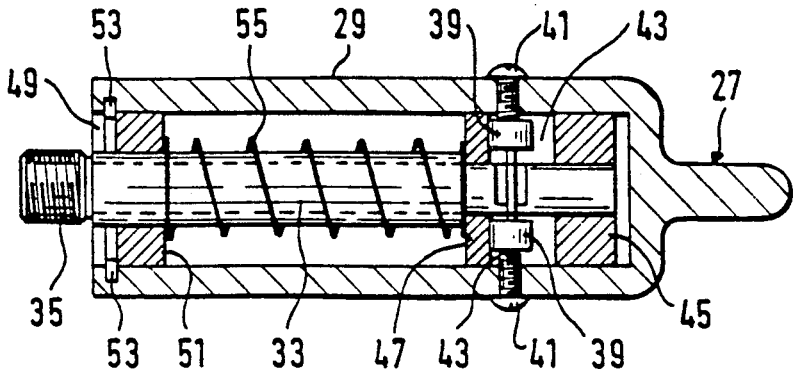
FIG. 5 is a cross-sectional view of the shaft and blade assembly shown in FIG. 4, taken in a plane perpendicular to the wings of the blade.

The X-ray beam modulator may programmed to start simultaneously with the anode rotation of the X-ray tube and cone assembly and then to operate continuously so as to be totally independent from the selected exposition sequence and duration that can be very short depending on the speed of screens use. FIG. 3 shows the kind of compensation curves that may be obtained in a lower limb angiography. It must be understood however that the X-ray beam modulator according to the invention may be used in other systems and is not restricted exclusively to be used with a lower limb angiography system.

What is claimed is:

1. An apparatus for modulating the intensity of an X-ray beam generated in a given direction by an X-ray tube, said apparatus comprising:

a rotor having a rotation axis parallel to said given direction, said rotor being positioned adjacent said X-ray beam;

means to drive said rotor about its rotation axis at variable speeds;

a set of at least three blades made of a material opaque to X-ray, each of said blades comprising a central hub and a pair of symmetrical wings extending away from said hub, the blades of said set having their hubs slidably mounted on a corresponding set of radially projecting shafts symmetrically positioned about said rotor;

return spring means to urge each of said blades radially inwardly towards said rotor along their respective shafts; and guiding means on each pair of hub and shaft to cause the corresponding blade to pivot about the shaft on which it is mounted when the speed of the rotor increases and the blades are then moved in unison radially outwardly against the action of the return spring means as a result of the centrifugal force;

wherein said blades and their shafts are sized to cause said blades to intersect said X-ray beam when said rotor is driven and thus to modulate the intensity of said X-ray beam as a function of the annular position of the blades about their shafts, which allow more or less radiation to pass therebetween.

2. The apparatus of claim 1, wherein the wings of said blades are so shaped as to cause variation in the modulation obtained therewith according to their skew angle, and thus to generate different compensation curves as a function of the rotation speed of the rotor.

3. The apparatus of claim 1, wherein said guiding means comprises a set of rollers freely mounted on pins symmetrically fixed to and projecting from any one of said hub and shaft in such a manner as to engage a corresponding set of threads made in the other one of said hub and shaft.

4. The apparatus of claim 3, wherein said return spring means comprises a compression spring mounted about said shaft within said hub.

5. The apparatus of claim 4, wherein:

said set of threads are made in a cylindrical member coaxially fixed to the shaft away from said rotor, said member having an external diameter wider than said shaft and defining a bearing flange;

said hub has an internal diameter substantially identical to the external diameter of said member and an opening adjacent said rotor, said opening being closed by a guiding ring fixed to said hub, said ring being slidably mounted onto said shaft; and said compression spring mounted about said shaft within said hub has one end bearing against said flange and another end bearing against said ring.

6. The apparatus of claim 5, wherein said pins and threads are positioned in such a manner that the blade extends at a small angle with respect to said given direction when the rotor is stopped or driven at low speed, and extends substantially horizontally when said rotor is driven at high speed.

7. The apparatus of claim 6, further comprising programmable control means operatively connected to said means to drive the rotor, said control means allowing preselection of at least one given speed of rotation of the rotor corresponding to a required compensation curve.

8. The apparatus of claim 7, wherein said X-ray tube generating the X-ray beam to be modulated is part of a system for lower limb angiography.

9. The apparatus of claim 7, wherein the wings of said blades are so shaped as to cause variation in the modulation obtained therewith according to their skew angle, and thus to generate different compensation curves as a function of the rotation speed of the rotor.

10. The apparatus of claim 1, further comprising programmable control means operatively connected to said means to drive the rotor, said control means allowing preselection of at least one given speed of rotation of the rotor corresponding to a required compensation curve.

* * * * *